US005117893A

United States Patent [19]

Morrison et al.

[11] Patent Number: 5,117,893

[45] Date of Patent: Jun. 2, 1992

[54] ROLLING SHUTTER SYSTEM

[75] Inventors: Donald L. Morrison, Huntington Beach; Tor H. Petterson; Stephen Bartok, both of Rancho Palos Verdes, all of Calif.

[73] Assignee: Excel Shutter Systems, Inc., Phoenix, Ariz.

[21] Appl. No.: 763,454

[22] Filed: Aug. 7, 1985

[51] Int. Cl.[5] ..... E06B 9/00

[52] U.S. Cl. ..... 160/291; 160/321

[58] Field of Search ..... 160/133, 321, 309, 310, 160/311, 319, 313, 23 R, 32, 41, 291; 464/30, 37, 38

[56] References Cited

U.S. PATENT DOCUMENTS

| | | | |
|---|---|---|---|
| 1,262,643 | 4/1918 | Coleman | 160/133 |
| 1,784,948 | 12/1930 | Rush | 160/310 |
| 1,947,070 | 2/1934 | Traut | 160/23 R |
| 2,577,046 | 12/1951 | Svirsky | 160/321 |
| 2,894,578 | 7/1959 | Caesar | 160/321 |
| 2,921,628 | 1/1960 | Alvarez | 160/201 |
| 3,158,195 | 11/1964 | Ney | 160/41 |
| 3,640,332 | 2/1972 | Luby | 160/133 |
| 3,840,061 | 8/1974 | Herms . | |
| 3,970,134 | 7/1976 | Sinnock | 160/133 |
| 4,131,039 | 12/1978 | Garconnet | 464/38 |
| 4,197,896 | 4/1980 | Reichstadt | 160/107 |
| 4,399,855 | 8/1983 | Volfson | 160/23 R |
| 4,422,493 | 12/1983 | Forquer | 160/309 |
| 4,424,852 | 1/1984 | Hopper | 160/309 |
| 4,436,136 | 3/1984 | Downey | 160/232 |
| 4,503,899 | 3/1985 | Forquer | 160/309 |

FOREIGN PATENT DOCUMENTS

| | | | |
|---|---|---|---|
| 265567 | 10/1968 | Austria | 160/23 R |
| 141454 | 5/1981 | European Pat. Off. | 160/313 |
| 0093289 | 11/1983 | European Pat. Off. . | |
| 0096664 | 12/1983 | European Pat. Off. . | |
| 2108898 | 10/1971 | Fed. Rep. of Germany | 160/133 |
| 2234879 | 1/1974 | Fed. Rep. of Germany . | |
| 2429422 | 1/1976 | Fed. Rep. of Germany . | |
| 2456461 | 8/1976 | Fed. Rep. of Germany | 160/291 |
| 2657656 | 7/1977 | Fed. Rep. of Germany | 160/321 |
| 2652927 | 5/1978 | Fed. Rep. of Germany | 160/133 |
| 2718829 | 9/1978 | Fed. Rep. of Germany | 160/291 |
| 2909275 | 9/1980 | Fed. Rep. of Germany | 160/291 |
| 3211506 | 10/1983 | Fed. Rep. of Germany . | |
| 3415878 | 10/1985 | Fed. Rep. of Germany | 160/23 R |
| 800441 | 5/1936 | France | 160/231 |
| 2428730 | 1/1980 | France . | |
| 2463846 | 2/1981 | France . | |
| 2490270 | 3/1982 | France . | |
| 6415020 | 6/1965 | Netherlands . | |
| 1042800 | 9/1966 | United Kingdom | 160/321 |
| 2070115 | 9/1981 | United Kingdom | 160/313 |

*Primary Examiner*—David M. Purol
*Assistant Examiner*—Robert A. Olson
*Attorney, Agent, or Firm*—Workman, Nydegger & Jensen

[57] ABSTRACT

A rolling shutter system employs a variable efficiency bi-directional drive mechanism which permits easy and quick raising of the rolling shutter while protecting against self-lowering of the shutter by reason of its own weight. The system also employs a novel operator for the bi-directional drive mechanism which is characterized by an easy and comfortable to grip bead string which also is attractive in appearance. The bead string is trained about a sprocket wheel, and an overload slip clutch is provided between the sprocket wheel and worm gear drive to limit the amount of force that can be applied to the bead string during raising and lowering of the rolling shutter. Also provided is a novel shutter travel limit and locking device, a novel valance construction and a novel through the wall shaft assembly.

32 Claims, 8 Drawing Sheets 32
160
251
261
280
260
250
258
249
257
256
248
246
253
99
254
16
15
14
17
266
272
270
271
269
252
276
277
278
267

ROLLING SHUTTER SYSTEM

DISCLOSURE

The invention herein disclosed relates generally to rolling shutter systems and, more particularly, to rolling shutter systems characterized by low cost, easy installation, easy and quick manual operation, reliability and improved exterior and interior appearance.

BACKGROUND

Conventional rolling shutters typically include an array of horizontal slats which are articulated or linked such that the shutter can be rolled or wound onto a storage roller. Storage roller drive mechanisms are used to rotate the storage roller in opposite directions to roll and unroll the shutter between shutter-open and shutter-closed positions. As the shutter slats are fed off the storage roller, opposite ends thereof are received and guided in side rails secured exteriorly to the side of a building at respective sides of the building opening being secured by the rolling shutter, such building opening usually including a window or door. The side rails usually are linear and retain the shutter slats in generally coplanar relationship parallel to the plane of the opening.

When retrofitting an existing building with a rolling shutter, common practice has been to mount the storage roller exteriorly of the building with a valance being provided to hide the rolled-up shutter from view. Prior valances or housing covers have been made of metal and have had a box-like appearance that was not particularly aesthetically pleasing.

In order to open and close the shutter from inside the building, an operator or controller such as a strap, crank or chain was provided inside the building and connected through the wall to the storage roller. This usually required the drilling of a hole through the wall to accommodate the element or elements coupling the operator inside the building wall to the drive components located outside the building wall.

One known type of storage roller drive mechanism used a crank as the interior operator. The crank was connected by a universal joint to the inside end of an axle which extended through a hole in the wall for inline connection to a worm. The worm was in mesh with a worm gear attached to the storage roller whereby rotation of the crank in one direction would raise the shutter and rotation in the opposite direction would lower the shutter. Although a bi-directional drive mechanism is desirable, one problem encountered with the foregoing type of crank drive mechanism was the need, during installation of the rolling shutter system, to drill the axle hole with a high degree of precision or make the hole excessively large in diameter to assure proper alignment of the shaft with the worm and a universal joint support secured to the side wall of the building. This generally discouraged installation of the rolling shutter system by individuals other than professional installers who had the proper tools and skill. Accordingly, such systems were not particularly suited for installation by the do-it yourself home owner.

The foregoing crank operated drive mechanism desirably was self-locking to prevent the rolling shutter from lowering by reason of its own weight. The self-locking feature, however, was heretofore provided at the cost of efficiency. Because of the inefficiency of the drive mechanism, whether raising or lowering the shutter, a high mechanical advantage (high gear ratio) was needed to keep operating force low. An undesirable consequence of this was that a large number of crank turns were needed to raise and lower the shutter. Even though the crank was easy to turn, the large number of needed crank turns made raising or lowering of the shutter a slow and somewhat tiresome task. Moreover, turning of the crank was a relatively unnatural human movement.

Narrow straps with retractor mechanisms also have been used. Generally, one end of the strap would be wound onto a large diameter drum coupled to the shutter storage roller outside of the building. From the drum, the strap would pass through a hole in the wall to a pulley mounted at the inside surface of the wall which directed the strap downwardly to a retractor mechanism also mounted to the inside surface of the wall. To raise the shutter one would pull down on the strap in a more natural human movement aided by gravity. When the strap was released, the retractor mechanism would engage to prevent reverse movement of the strap. To lower the shutter, the strap was pulled away from the wall to release a length of the strap from the retractor mechanism and then allowed to move back towards the wall to allow the shutter to lower by its own weight a distance determined by the length of strap released by the retractor mechanism. This procedure was relatively awkward and had to be repeated many times to completely lower the shutter from its fully raised position. Another problem has been that if the retractor mechanism should fail or the strap break, the shutter could crash down by reason of its own weight. Also, the strap had to be gripped tightly to prevent the strap from slipping in the operator's hand. Accordingly, persons with weak grips have had difficulty with strap operated shutter systems.

Another problem associated with indirect drive systems, i.e., those systems that rely solely on gravity to lower the rolling shutter, was that when the shutter stuck in an open position, one had to reach out through the building opening to pull the shutter down at least to get lowering movement started. Moreover, the shutter more likely would stick in the usually more difficult to reach fully raised position when gravity forces acting to lower the shutter are the lowest.

Another problem associated with bi-directional drive mechanisms, whether operated with a crank or otherwise, has been damage to the system when attempting to lower the shutter too far or when stuck.

Known rolling shutters also have been provided with a mechanism to prevent the shutters from being raised from the outside when in their fully closed position. A common approach has been to use straps to connect the top slat of the shutter to the storage roller. When one attempted to raise the shutter from the outside, the uppermost shutter slat could move relative to the storage roller for jamming against the top wall of the shutter housing or valance. Nevertheless, the shutter could still be lifted somewhat until the jamming occurred. Also, it is more desirable in bi-directional drive systems to directly connect the rolling shutter to the storage roller for more positive driving of the rolling shutter.

SUMMARY OF THE INVENTION

The present invention provides a rolling shutter system which overcomes one or more drawbacks associated with prior rolling shutter systems while obtaining additional advantages and benefits including low cost, easy installation, easy and quick manual operation, reliability and improved exterior and interior appearance. In particular, the system employs a variable efficiency bi-directional drive mechanism which permits easy and quick raising of the rolling shutter while protecting against self-lowering of the shutter by reason of its own weight. The system also employs a novel operator for the bi-directional drive mechanism which is characterized by an easy and comfortable to grip bead string which also is attractive in appearance. The bead string is trained about a sprocket wheel, and an overload slip clutch is provided between the sprocket wheel and worm gear drive to limit the amount of force that can be applied to the bead string during raising and lowering of the rolling shutter. Also provided is a novel shutter travel limit and locking device, a novel valance construction and a novel through the wall shaft assembly.

According to one aspect of the invention, the rolling shutter system comprises a rolling shutter, a bi-directional drive for rolling and unrolling the shutter respectively to raise and lower the shutter, and a one-way friction clutch device for causing relatively high frictional resistance to lowering movement of the shutter and relatively low frictional resistance to raising movement of the shutter. More particularly, the bi-directional drive preferably includes a worm and worm gear and the one-way friction clutch device includes a friction element and a clutch for coupling the friction element to the worm for rotation with the worm in one direction only. The bi-directional drive preferably is of high efficiency while the friction element operates to prevent self-lowering of the rolling shutter by adding friction, i.e., inefficiency, into the system.

According to another aspect of the invention, a rolling shutter system comprises a rolling shutter and a bi-directional drive for rolling and unrolling the shutter, such drive including a sprocket wheel and a bead string trained around the sprocket wheel. The bead string consists of a plurality of generally round plastic beads molded to a flexible string which preferably is inextensible, i.e., dimensionally stable. The bead string may be used in place of a conventional chain drive but preferably the bead string has flights thereof depending from the sprocket wheel for hand grasping and pulling. The flights preferably are of considerable length to permit downward pulling of the bead string over a considerable distance to effect relatively rapid raising and lowering of the rolling shutter with relatively little effort. The size of the beads and the spacing therebetween preferably are selected to provide a comfortable hand grip. Further in conjunction with the sprocket wheel there is provided a spider clutch spring which operates to couple the sprocket wheel to a sprocket shaft while allowing the sprocket wheel to rotate relative to the sprocket shaft when torque acting on the sprocket wheel exceeds a predetermined amount to prevent excessive forces from acting on the bead string that might cause the bead string to break or otherwise be damaged.

According to still another aspect of the invention, a rolling shutter system comprises a rolling shutter, a pair of vertical guide rails for the shutter, a reel assembly for raising and lowering the shutter in the guide rails by rolling and unrolling the shutter, a catch rotatable with the reel assembly, and an obstruction movable in relation to the rolled condition of the shutter for engaging the catch to prevent further rotation of the reel assembly in a shutter lowering direction only when the shutter is fully lowered in the guide rails. The catch also serves to lock the obstruction against movement when engaged therewith, and the obstruction when locked against movement serves to block lifting of the rolling shutter.

According to a further aspect of the invention, there is provided in the rolling shutter system a valance comprising generally parallel top, bottom and front panels. Such panels include interlocking elements for securing together respective adjacent edges of the panels. Also provided are end caps for telescoping over the ends of the panels when secured together. As will be appreciated, the generally planar panels, preferably made of plastic material, may be relatively easily cut for sizing to a particular building opening while the end caps serve to hide from view the cut ends of the panels.

Still other features of the present invention relate to the hereinafter described through the wall shaft assembly employing a novel ball and socket joint, and a chassis mount for the worm of the bi-directional drive which is attachable to an end plate at either end of a rolling shutter housing for left-hand or right-hand operation, which selective attachment requires, in addition to the chassis, removal and reinstallation of only one screw fastener.

To the accomplishment of the foregoing and related ends, the invention, then, comprises the features hereinafter fully described and particularly pointed out in the claims, the following description and the annexed drawings setting forth in detail a certain illustrative embodiment of the invention, this being indicative, however, of but one of the various ways in which the principles of the invention may be employed.

DETAILED DESCRIPTION

Figure 2:
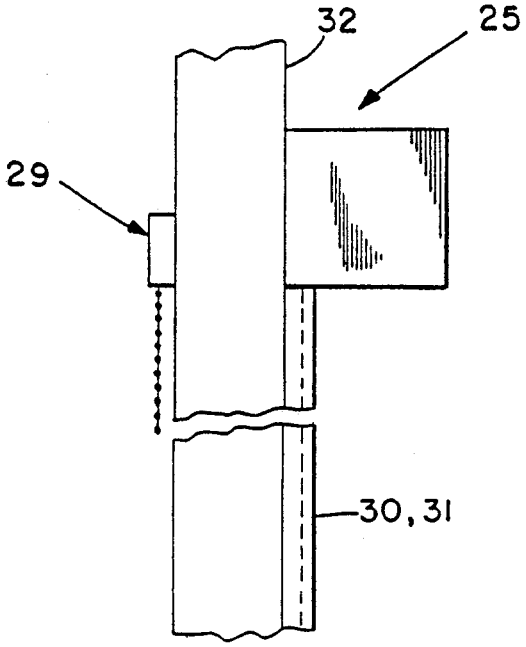
FIG. 2 is a fragmentary end elevational view of the rolling shutter system, in relation to the building wall.
Figure 1:
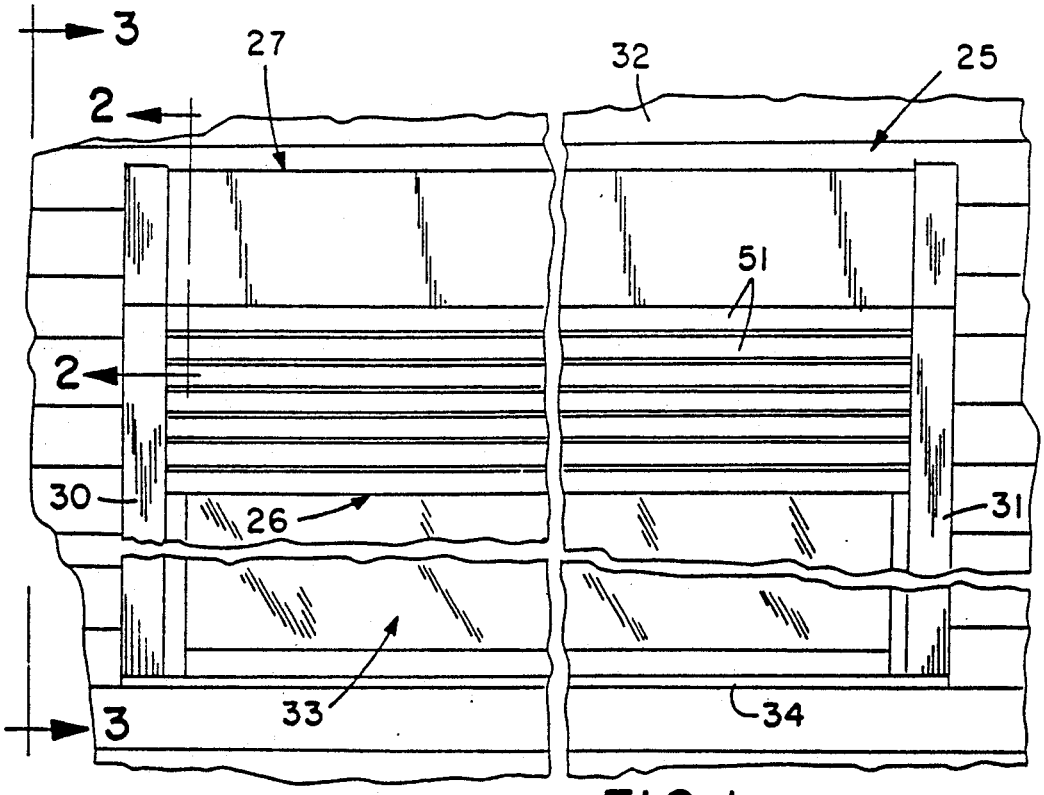
FIG. 1 is a fragmentary front elevational view of a rolling shutter system according to the invention, as installed on the side wall of a building.

Referring now in detail to the drawings and initially to FIGS. 1 and 2, a rolling shutter system according to the invention is indicated generally at 25. The rolling shutter system 25 generally comprises a rolling shutter 26, a storage housing 27 for the rolling shutter, a bi-directional reduction drive 28 (FIGS. 3 and 4), an operator 29 for the reduction drive, and a pair of side rails 30 and 31. As shown, the housing 27 and side rails 30 and 31 may be exteriorly mounted to a side wall 32 of a building at an opening 33 in such side wall, whereas the operator 29 is interiorly mountable to the side wall and coupled through the wall to the reduction drive in the housing 27 in a manner hereinafter described. The building opening 33 may be, for example, one containing a door or, as illustrated, a window. The housing is located above and parallel to the top edge of the building opening and the side rails are mounted at and parallel to respective sides of the building opening as is typical of conventional rolling shutter installations. The side rails extend downwardly from the housing to a sill 34 against which the rolling shutter may be lowered to close the building opening.

Figure 5:
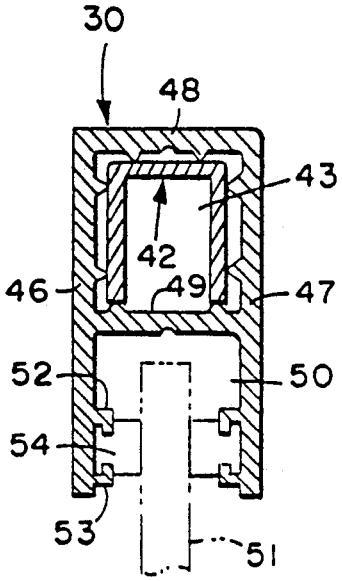
FIG. 5 is a horizontal section taken substantially along the line 5—5 of FIG. 3.
Figure 3:
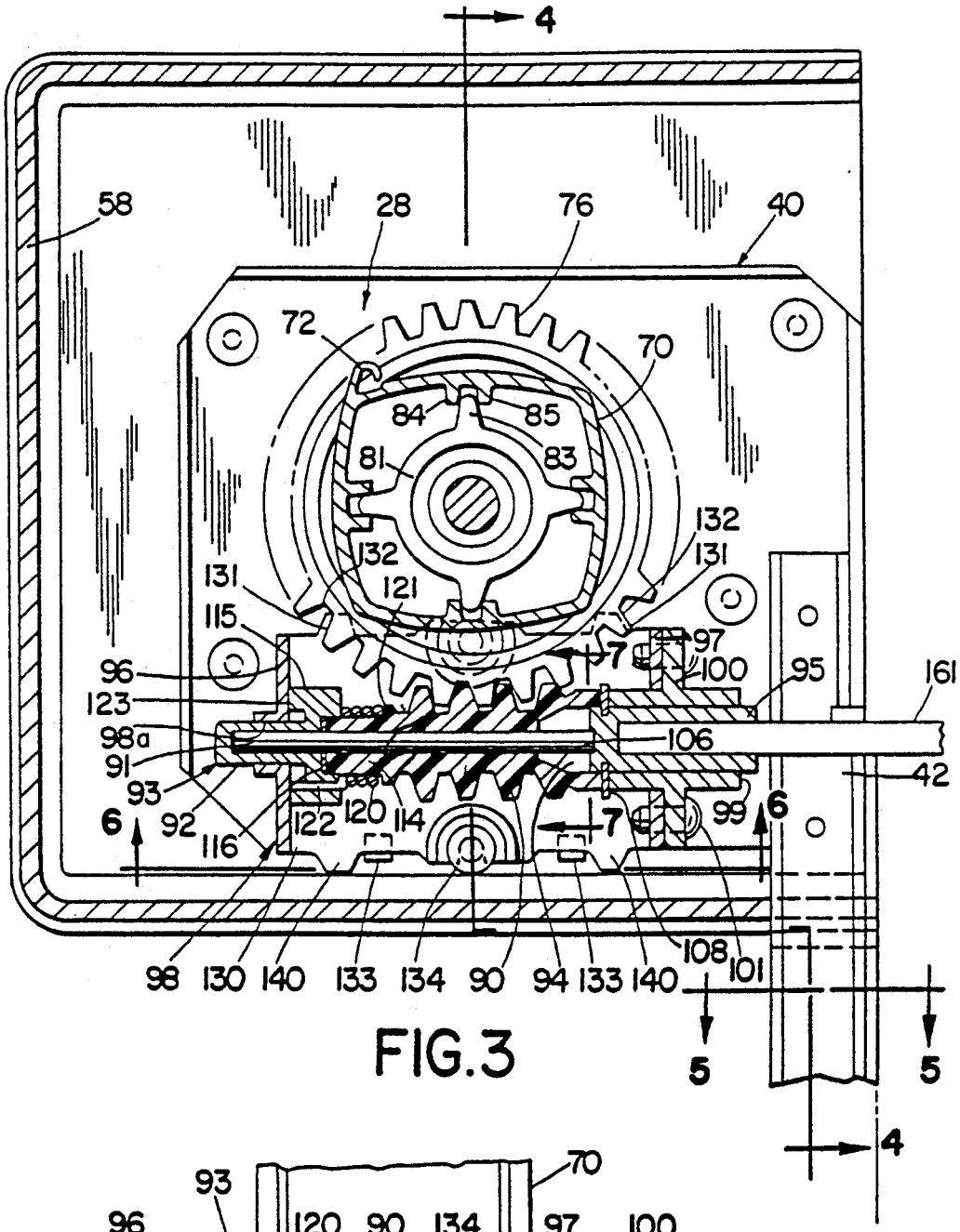
FIG. 3 is an enlarged vertical transverse section through the rolling shutter system taken substantially along the line 3—3 of FIG. 1.
Figure 4:
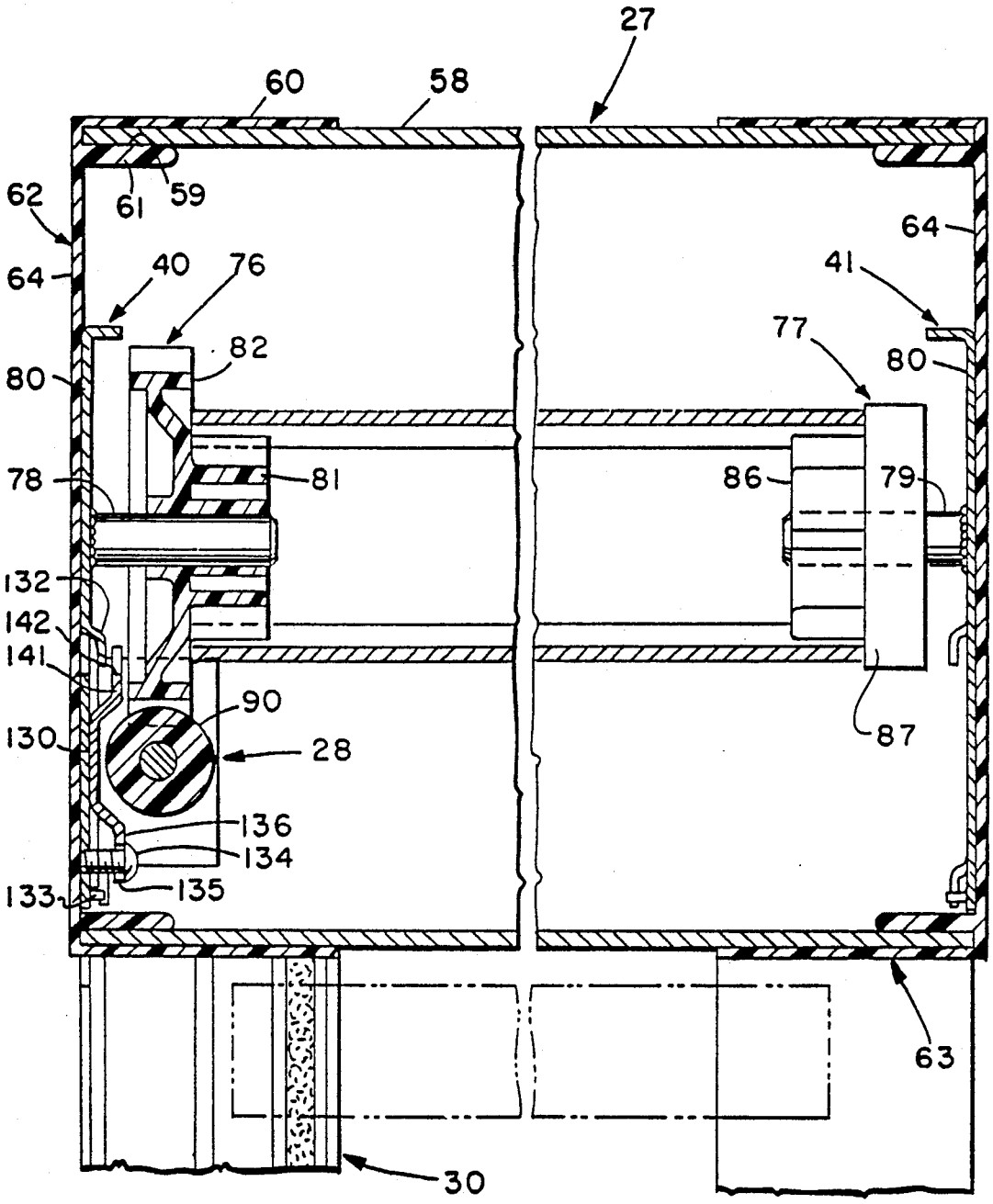
FIG. 4 is a fragmentary width-wise vertical section through the rolling shutter system taken substantially along the line 4—4 of FIG. 3.

In FIGS. 3 and 4, the storage housing 27 can be seen to include, at opposite ends thereof, respective end plates 40 and 41 which are mirror images of one another. As seen in FIG. 3, the end plate 40 has secured thereto, as by spot welding, a depending coupling leg 42 which is generally parallel to and inwardly adjacent the rear vertical edge of the end plate. As seen in FIG. 5, the coupling leg 42 has a C-shape cross section dimensioned to fit telescopically into the upper open socket end of a channel 43 provided in the side rail 30 for connection and proper positioning of the end plate 40 with respect to the side rail. The side rail 30 may be secured vertically to the building side wall 33 by suitable means and then the end plate 40 may be mounted to the side rail by inserting the coupling leg thereof into the upper socket end of the channel 43 with the coupling leg and channel walls cooperating to hold the end plate vertical and also perpendicular to the outside surface of the building side wall 32. Although not clearly shown, the end plate 41 at the other end of the housing 27 similarly is provided with a depending coupling leg for mounting of the end plate to the right-hand side rail 31 which is a mirror image of the side rail 30.

In FIG. 5, further details of the left-hand side rail 30 can be seen. Such side rail is an extruded elongate member including a front wall 46, a rear wall 47, an outer side wall 48, and an intermediate wall 49. The front wall 46 and rear wall 47 project beyond the intermediate wall 49 to form a U-shape track 50 for guiding the slats 51 of the rolling shutter 26 along a vertical path during raising and lowering of the rolling shutter in the below described manner. Adjacent the inner edges of the front and rear walls 46 and 47 are respective pairs of opposed hooks 52 and 53 which retain wiper elements 54 which engage front and rear surfaces of the shutter slats to effect a seal. At their outer ends, the front and rear walls 46 and 47 form with the intermediate wall 49 and the outer side wall 48 the aforementioned channel 43. The front wall 46 bounding the channel 43 may be provided with apertures aligned with smaller apertures in the rear wall 47 for passage of fasteners such as nails or screws employed to secure the side rail 30 to the building wall 32. The right-hand side rail 31, as above indicated, is a mirror image of the left-hand side rail 30. As is preferred, the side rails 30 and 31 are identical extrusions except that one is inverted and oppositely disposed to the other.

Referring again to FIGS. 3 and 4, the storage housing 27 further includes a cover 58 which is C-shape in transverse vertical section. The ends of the cover are each telescopically received in a slot 59 formed between outer and inner peripheral flanges 60 and 61 of a respective end cap 62, 63. Each end cap 62, 63 has a substantially planar vertical wall 64 which may be generally rectangular in shape and which is bounded at its top, bottom and front edges by the peripheral flanges 60 and 61. The end caps 62 and 63 are secured at their vertical walls 56 to the end plates 40 and 41, respectively, as by means of screws or other suitable fasteners with the cover 58 being held therebetween. The cover and end caps together form a valance or housing cover which is interiorly dimensioned to accommodate the rolling shutter 26 when rolled and also the reduction drive 28 which is hereinafter described in detail.

The rolling shutter 26, shown partly lowered in front of the building opening 32 in FIG. 1, may be of conventional type including an array of the aforementioned horizontal shutter slats 51 which are hinged, linked or otherwise articulately connected such that the rolling shutter can be rolled, reeled or wound onto a storage roller or spool indicated at 70 in FIG. 4. When unrolled or unwound from the storage spool 70, opposite ends of the shutter slats 51 are received, guided and retained in the tracks 50 of the side rails 30 and 31 which further serve to hold the deployed or lowered shutter slats in generally coplanar relation parallel to the building side wall 32 in front of the building opening 33. Although any suitable rolling shutter construction may be utilized, a preferred construction is that shown and described in applicant's assignee's copending U.S. patent application Ser. No. 06/763,453, filed even date herewith and entitled "Rolling Shutter Construction".

The storage spool 70 preferably is in the form of an extruded tube of generally square cross-sectional shape. As seen in FIG. 3, the sides of the storage spool are slightly outwardly convex to provide for close abutment with the concave outer surfaces of the innermost shutter slats wound around the storage spool, such shutter slats preferably having the slat configuration disclosed in the above mentioned copending application. Along one corner of the storage spool there is provided an outwardly projecting hook member 72 by which the top end slat of the rolling shutter may be articulately connected to the storage spool.

In FIGS. 3 and 4, the storage spool 70 can be seen to be journaled for rotation about its axis between the end plates 40 and 41 by means of a worm gear 76 and a plug member 77 at respective ends of the storage spool. The worm gear 76 and plug member 77 are supported for rotation on axle pins 78 and 79 which are secured to the end plates 40 and 41, respectively. Each axle pin 78, 79 extends perpendicularly to the vertical wall 80 of the respective end plate 40, 41 and the worm gear and plug member each has an axial bore at its center in which the respective axle pin is received. As seen at the left in FIG. 4, the worm gear has a hub portion 81 which extends axially inwardly from a toothed portion 82 for socket-like receipt in the adjacent open end of the storage spool 70. The storage spool is coaxially supported and keyed to the hub portion of the worm gear by axial ribs 83 which project radially outwardly from the hub portion 81 to support and fit between respective pairs of spaced axially extending flanges 84 and 85 which project inwardly from respective side walls of the storage spool. The plug member 77 has a similar hub portion 86 which extends axially inwardly from an enlarged diameter portion 87 for socket-like receipt in the adjacent open end of the storage spool for supporting the storage spool coaxially with the common axis of the axle pins 78 and 79.

As will be appreciated, rotation of the storage spool 70 about its axis in one direction (counterclockwise in FIG. 3) will cause the rolling shutter 26 to wind around the storage spool to raise the rolling shutter in the side rails whereas rotation in the opposite direction (clockwise in FIG. 3) will cause the shutter to unwind from the storage spool to lower the rolling shutter in the side rails. Such rotation of the shutter spool is positively effected by the bi-directional reduction drive 28.

Figure 6:
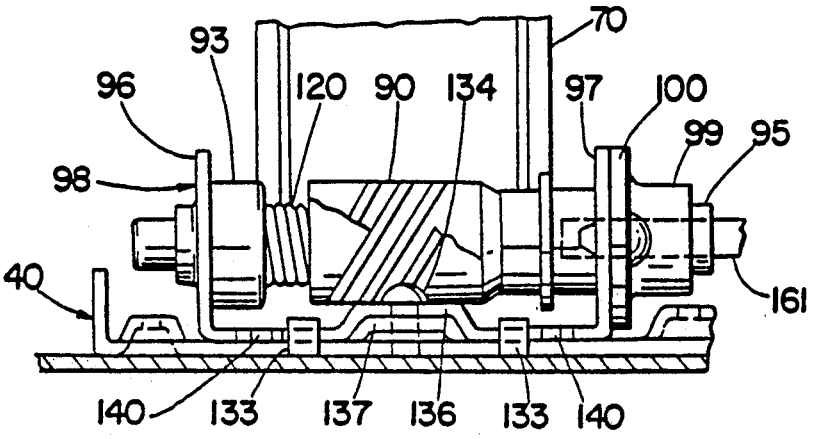
FIG. 6 is a view looking generally in the direction of the arrows 6—6 of FIG. 3.

As seen in FIGS. 3, 4 and 6, the reduction drive 28 includes the worm gear 76 and a worm 90 in mesh with the worm gear. The worm 90 is supported for rotation on a support shaft 91. One end of the support shaft 91 is supported in the hub portion 92 of a friction bearing 93 whereas the other end of the support shaft is concentrically supported between circumferentially spaced apart, axially extending teeth 94 of a gear actuator 95. The friction bearing 93 and gear actuator 95 are supported for rotation about a common axis by respective legs 96 and 97 of a U-shape worm support chassis 98 which is attached to the vertical wall 80 of the end plate 40. More particularly, the hub portion 92 of the friction bearing 93 is supported for rotation in an upset bearing hole 98*a* in the leg 96 whereas the gear actuator 95 is supported for rotation in a bushing 99 which extends through a hole in the leg 97. The bushing 99 has a radially outwardly extending annular flange 100 for securing the bushing to the leg 97 by fasteners 101.

Figure 7:
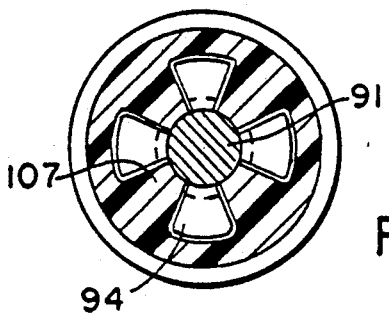
FIG. 7 is an enlarged section taken substantially along the line 7—7 of FIG. 3.

The rear shaft end of the worm 90 is recessed at 106 to accommodate interiorly thereof the teeth 94 of the gear actuator 95. At the recess 106, the worm is provided with radially inwardly projecting, axially extending teeth 107 which circumferentially interfit with the teeth 94 of the gear actuator as seen in FIG. 7. In this manner, the worm is coupled to the gear actuator for common rotation. It also is noted that the worm and gear actuator will remain coupled while permitting some relative axial shifting of the worm and gear actuator. Such relative shifting is limited in one direction by a retaining clip 108 which has its radially inner peripheral edge received in a circumferential groove on the O.D. of the gear actuator. The radially outer portion of the retaining clip is axially interposed between the worm and the gear actuator bushing 99.

Axial shifting of the worm 90 in the opposite or forward direction is limited by engagment with the friction bearing 93. The front shaft end 114 of the worm extends into a counterbore provided in a diametrically enlarged head portion 115 of the friction bearing 93. A low friction thrust bearing washer 116 is axially interposed between the bottom of the counterbore and the axial end face of the worm.

In use, the worm 90 will normally be urged axially against the low friction thrust bearing washer 116 by reason of the weight of shutter slats not rolled onto the storage spool 70. Even when the rolling shutter is fully raised in the side rails 30 and 31, a suitable stop (not shown) is provided to prevent the bottom shutter slat from being withdrawn out of the side rails or, if provided, an entry guide at the top end of the side rails. Accordingly, there will always be at least one and usually several slats which are not wound onto the storage spool. The weight of the slats which are not rolled onto the storage spool will try to rotate the storage spool clockwise in FIG. 3. This gravity caused torque acting on the storage spool will cause the worm gear 76 to apply a force to the worm which force has an axial component serving to urge the worm axially against the thrust bearing washer 116.

The worm gear 76 and worm 90 preferably are of high efficiency, as is the hereinafter described operator 29 for the reduction drive 28. By way of example, the worm gear may be a 10 Dp. nylon gear whereas the worm may be a fast, 4-lead poly-acetal worm providing approximately 75% average efficiency. Also, the gear ratio may be varied for different shutter sizes and weights. For example, a 4:1 gear ratio may be used for small shutters whereas an 8:1 gear ratio may be used for larger shutters. In any event, it is preferred that the drive be highly efficient to reduce the force needed to raise the rolling shutter.

Although desirably highly efficient in the shutter raising direction, the reduction drive 28 preferably is rendered inefficient in the shutter lowering direction to prevent the rolling shutter from crashing down by reason of its own weight. In accordance with the invention, this is accomplished by a friction device which operates to introduce frictional resistance to lowering of the rolling shutter but not raising of the rolling shutter. The friction device includes the friction bearing 93 and a one-way clutch in the form of a coil spring 120. The spring 120 surrounds the shaft end 114 of the worm 90 and is interposed between the head portion 115 of the friction bearing and a radially outwardly projecting annular flange 121 on the worm. One end of the spring 120 is fixed to the friction bearing by an axially extending tab portion 122 which is received in a small axial hole in the friction bearing. As for the coils of the spring, such are slightly radially outwardly expanded to fit on and frictionally grip the worm shaft end 114. Accordingly, the spring 120 normally serves to couple the friction bearing to the worm. Moreover, the sense of the coil spiralling around the worm shaft end 114 is such that rotation of the worm in a shutter lowering direction will, through frictional engagment with the coils of the spring, cause the spring to tighten even more around the worm shaft end 114 thereby to maintain the friction bearing coupled to the worm. On the other hand, rotation of the worm in a shutter raising direction will cause the coils of the spring to expand and allow the worm to turn relative to the friction bearing. Accordingly, the friction bearing will be decoupled from the worm whenever the worm is being rotated in the shutter raising direction.

The function of the friction bearing 93 is to inroduce into the system frictional resistance, i.e., inefficiency, sufficient to prevent lowering of the rolling shutter by reason of its own weight at any position of the rolling shutter. That is, the amount of frictional resistance added into the system plus that existing in the system (by itself insufficient) should be sufficient to prevent the shutter from lowering itself even when almost fully closed. As seen in FIG. 3, the head portion 115 of the friction bearing has an axial end face 123 of relatively large diameter which frictionally engages the inside surface of the leg 96 of the worm support chassis 98. Because of the large moment arm associated with the frictional forces at the surface 123, the worm drive may be artificially made sufficiently inefficient to prevent self-lowering of the rolling shutter. The gravity induced force urging the worm axially against the thrust bearing washer 116 will in turn axially urge the friction bearing surface 123 against the inside surface of the leg 96 of the worm support bracket 98.

In view of the foregoing, the system has high efficiency when raising the shutter thereby minimizing the amount of effort needed to raise the shutter, while a lower efficiency in the shutter lowering direction prevent the shutter from lowering itself by reason of its own weight. Preferably the added resistance to lowering of the rolling shutter is enough with a safety margin to prevent self-lowering of the shutter without being so great as to require more effort to lower the shutter than to raise the shutter. It is noted that during lowering of the shutter that the weight of the shutter will assist the reduction drive.

As above indicated, the worm support chassis 98 is attached to the end cap 40. In accordance with the invention, the base wall 130 of the worm support chassis is formed at its top edge with a pair of upwardly protruding tabs 131. The tabs 131 are sized to fit into respective downwardly opening pockets 132 formed by inwardly upset or raised portions of the end plate wall 80. The tabs are precluded from falling out of the pockets by inwardly bent lugs 133 at the bottom edge of the end plate which lugs engage the bottom edge of the base wall 130. To prevent the base wall from pivoting away from the end plate wall 80 and out of engagement with the lugs 133, a single screw fastener 134 is provided to hold the base wall 98 flush against the end cap wall 80. To accommodate the shank of the fastener 134 the base wall 130 has an aperture 135 adjacent its lower edge at a raised boss-like portion 136 of such base wall. The end plate wall 80 may also be provided with a raised boss-like portion 137 which fits within the raised portion 136 of the bottom wall 130, such raised portion 137 having a hole into which the fastener 134 may be threaded.

The base wall 130 also is formed at its bottom edge with another pair of tabs 140 and at its top edge with another raised boss portion 141 including an aperture 142. As seen in FIG. 3, the tabs 131 and 140 are symmetrically arranged with respect to both the vertical and horizontal and particularly with respect to the horizontal plane through the rotational axis of the worm 90. The raised boss portions 136 and 144 also are symmetrically disposed and centrally of the respective tabs 131 and 140.

It will be appreciated that the symmetrical arrangement of the tabs 131 and 140 and raised bosses 136 and 144 permits attachment of the worm support chassis 98 to either the left-hand end plate 40 or the right-hand end plate 41 which, as above indicated, is a mirror image of the end plate 40. To switch the worm support chassis from one side to the other, all one need do is remove the single fastener 134, slightly tilt and remove the worm support chassis from the end plate 40, then rotate the worm chassis 180° about the axis of the worm 90, and finally effect its securement to the other end plate as above described using the same single fastener 134. It also is noted that the drive components assembled to the worm support chassis will be moved as a unit with the chassis and properly oriented at the other side of the storage housing 27. During such switching from left hand to right hand operation, the storage spool 70 also may be simply flipped over to locate the worm gear 76 at the same side as the relocated worm 90.

Referring now to FIGS. 8–11, the preferred operator or controller 29 for the reduction drive 28 includes a sprocket housing 150 consisting of outer and inner halves 151 and 152. The outer and inner halves are securable together and to the inside surface of the building wall 32 by means of fasteners 153 such as screws, molly bolts or the like.

When secured together, the outer and inner halves 151 and 152 of the housing 150 form therebetween an interior chamber 156 for a sprocket wheel 157 about which an endless bead string 158 is trained. The sprocket 157 is coupled by an overload slip clutch 159 to a sprocket shaft 160 which in turn is coupled to one end of a flexible shaft 161. The flexible shaft 161 extends through the building side wall 32, as through a hole drilled therein, for connection at its other end to the gear actuator 95 (FIG. 3). The flexible shaft 161 may be fixedly secured to the gear actuator 95 whereas a quick connect/disconnect 162 may be provided to couple the sprocket shaft 160 to the flexible shaft 161 after the latter has been threaded through the hole in the building side wall. The flexible shaft may have fixed thereto a coupling element 163 of non-circular cross section which may be axially inserted into a socket 164 of corresponding non-circular cross section provided in the sprocket shaft 160.

The bead string 158 comprises a plurality of beads 168 which are joined to an elongate flexible element such as a continuous length of string 169 at equally spaced intervals along the string. The string preferably is axially inextensible and formed from a plurality of woven strands. The beads preferably are of plastic material and molded to the string with sufficient molding pressure to force the plastic material of the beads into the interstices between the strands of the string thereby upon cure to provide a mechanical interlock between the beads and the string as well as bonding of the beads to the string. For preferred materials and method of manufacture of the bead string, reference may be had to applicants' assignee's copending U.S. patent application Ser. No. 06/763,455, filed even date herewith and entitled "Bead String Manufacture", which application is hereby incorporated herein by reference.

The size of the beads 168 and the spacing therebetween preferably is selected to provide a comfortable hand grip. More particularly, the bead size and spacing is selected so that fingers curling around the bead string to grip it will comforatbly interdigitate between respective relatively adjacent pairs of beads. That is, the spacing between the beads preferably permits the fingers to fit between the beads with the fingers coming just into contact with the string. As for the size of the beads, such is selected so as not to cause an uncomfortable separation of the fingers grasping the bead string. It is important that there by substantial axial interference over a relatively large surface area between the fingers and respective beads to minimize the amount of gripping force required to pull the chain axially against a given resistance and further to minimize pressure concentration on the fingers. On the other hand, the beads should not be so large or spaced so far apart that the spaced intervals therebetween do not substantially align with the average spacing of fingers of a person's hand. The beads preferably are spherical and preferably have a diameter of about 0.438 inch and a preferred center-to-center spacing of about 0.771 inch.

The bead string 158 preferably is a continuous loop that is trained at its upper end around the sprocket 157. The bead string may simply hang from the sprocket or the lower end of the bead string may be trained, for example, around an idler sprocket mounted to the building side wall 32. The bead chain preferably has a length which allows a person to grab either vertical flight of the bead string and then pull downwardly over a considerable distance preferably on the order of about 4 feet. As will be appreciated, the motion of one's arm pulling down on the bead string is a natural human movement aided by gravity. As a result, the bead string may be pulled down relatively quickly over a considerable distance to effect with each pull relatively fast and multiple turns of the sprocket shaft 160 particularly in relation to the speed at which traditional cranks may be rotated. Also, pulling down on one vertical flight of the bead string will rotate the drive shaft in a shutter-raising direction whereas pulling down on the other flight of the bead string will rotate the drive shaft in the opposite or shutter lowering direction.

Figure 8:
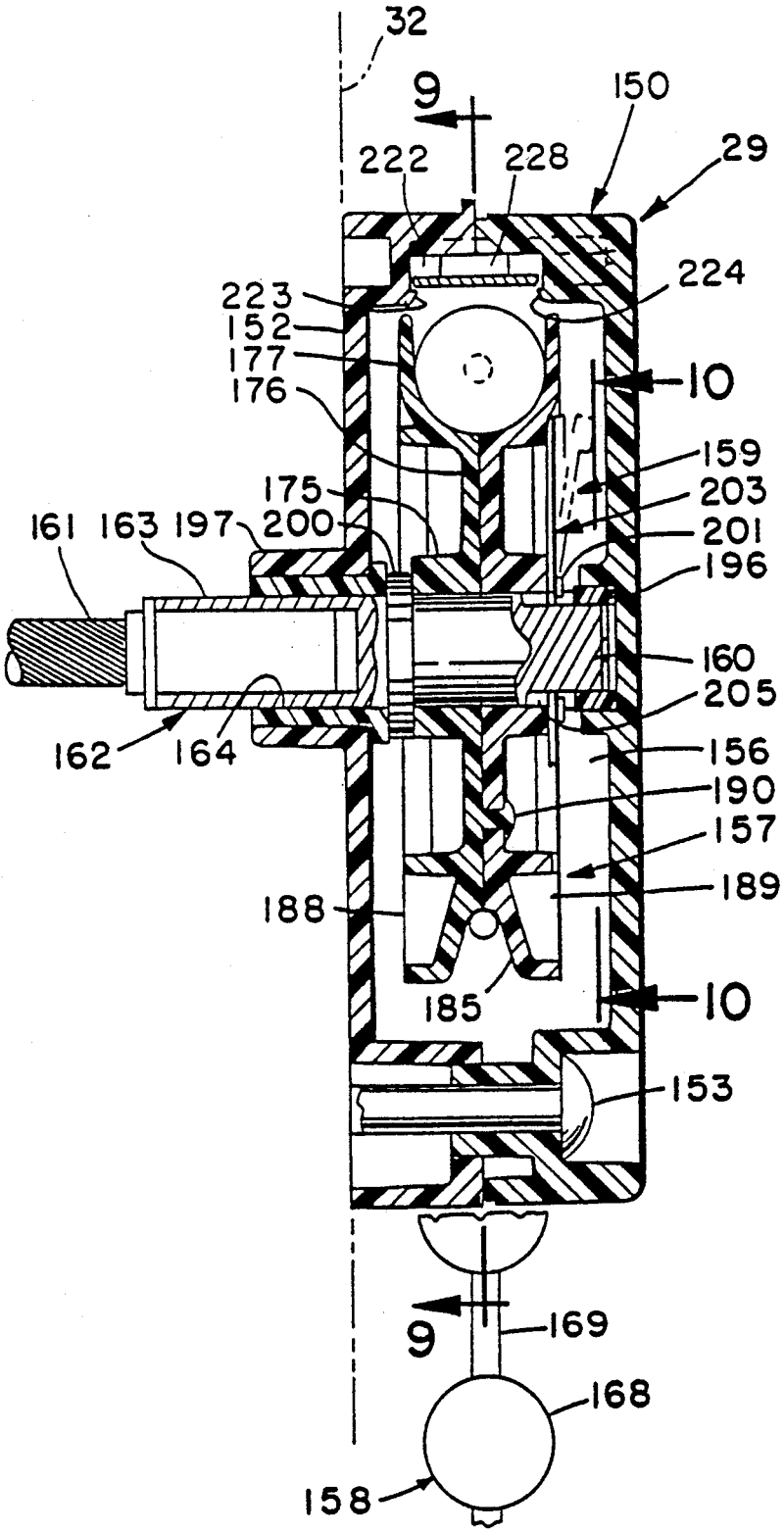
FIG. 8 is a vertical section through the operator of the rolling shutter system.
Figure 9:
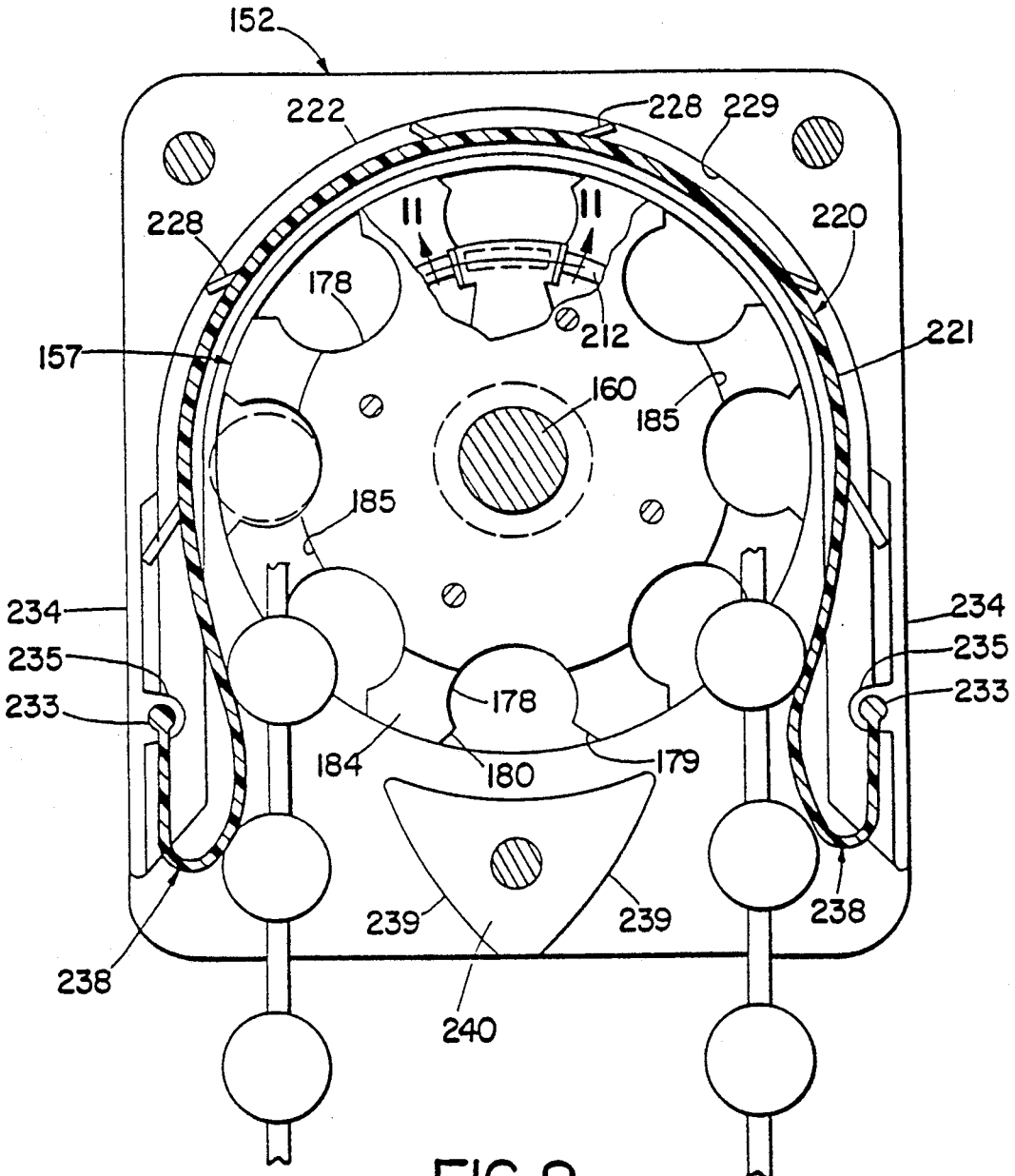
FIG. 9 is another vertical section through the operator taken substantially along the line 9—9 of FIG. 8.

In FIGS. 8 and 9, the sprocket wheel 157 can be seen to have a hub portion 175, a radial flange portion 176 and a bead socket portion 177. The bead socket portion 177 is formed with a plurality of circumferentially spaced apart bead sockets 178 for receiving the beads 168 of the bead string 158. Each bead socket 178 has a generally spherical radially inner portion and a tapered outer portion which serves to guide a bead into the socket. As seen in FIG. 9, the bottom of each bead socket is slightly circumferentially elongated from a truly spherical shape to permit some circumferential play of the beads in the sockets. Also, the outer portion of each socket preferably has only the circumferential sides thereof tapered as seen at 179 in FIG. 9 while the axial sides are substantially parallel to minimize axial play of the beads in the sockets as seen in FIG. 8. As is preferred, the union between the inner and outer portions of the bead sockets is defined by a neck 180 of lesser dimension which facilitates retention of the beads in the sockets during rotation of the sprocket wheel.

Relatively adjacent sockets 178 define therebetween a respective tooth-like portion 184. Each tooth-like portion 184 has formed therein a circumferential groove 185 which opens to the O.D. of the sprocket wheel 157. The grooves 185 accommodate respective string segments between respective relatively adjacent beads received in the sockets 178.

The sprocket wheel 157 preferably is made of molded plastic material and, in the illustrated embodiment, the sprocket wheel is formed from two molded axial halves 188 and 189. The axial halves are each a mirror image of the other and are secured together at the flange portion 176 by snap-lock connecting elements 190.

The sprocket wheel 157 is supported at its hub portion 175 on the sprocket shaft 160 for rotation relative to but about the axis of the sprocket shaft. The sprocket shaft is supported for rotation in the housing by bearings 196 and 197 which are respectively held in a cylindrical recess in the outer housing half 151 and a tubular projecting portion of the inner housing half 152. The sprocket hub portion 175 is axially trapped on the sprocket shaft between a collar 200 on the shaft and a retaining clip 201 received in a groove on the O.D. of the shaft. Axially interposed between the retaining clip and sprocket hub portion 175 is the hub portion 202 of a spider clutch spring 203. The spider clutch spring 203 is keyed to the shaft as by means of spline-like projections 204 (FIG. 10) which engage in respective grooves 205 at the O.D. of the shaft.

Figure 11:
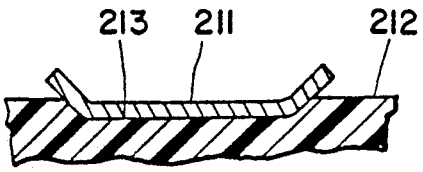
FIG. 11 is a fragmentary arcuate section taken substantially along the line 11—11 of FIG. 9.
Figure 10:
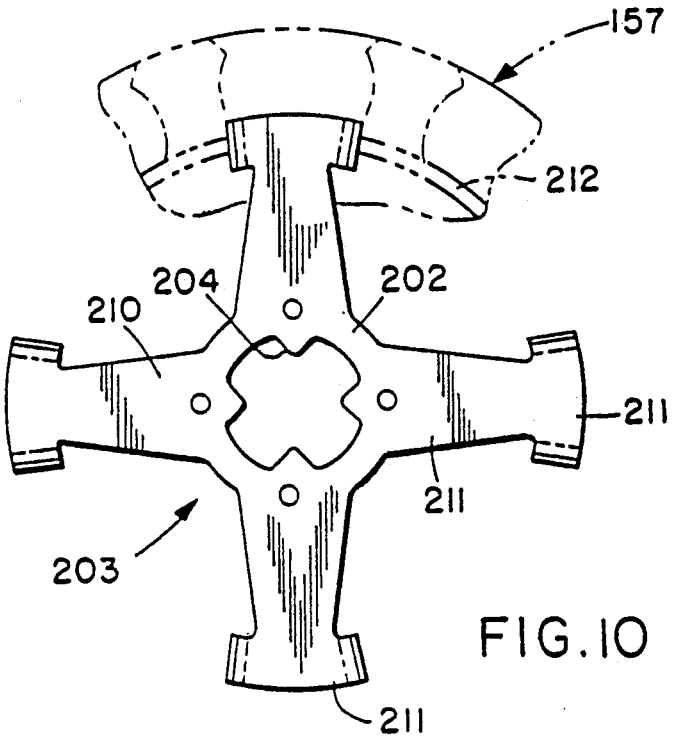
FIG. 10 is an enlarged elevational view of the spider spring employed in the operator looking generally in the direction of the arrows 10—10 of FIG. 8.

As best seen in FIG. 10, the spider clutch spring 203 further includes four radially outwardly extending spring arms 210 which terminate at respective hammerhead-like catches 211. The catches 211 are urged by the resiliency of the spring arms into engagement with an axially facing, annular surface 212 of the sprocket wheel. Such annular surface 212 is provided with four circumferentially spaced apart recesses or grooves 213 arranged and configured to receive respective catches of the spider clutch spring as seen in FIG. 11.

The spider clutch spring 203 serves to bi-directionally couple the sprocket wheel 157 to the sprocket shaft 160 while preventing overload torques from being applied to the system. When the catches 211 are seated in the grooves 213, the resultant interference will cause the spider clutch spring to turn with the sprocket wheel for transmission of torque from the sprocket wheel to the sprocket shaft 160 in either direction. However, when the torque being transmitted exceeds a predetermined amount which causes the catches to be cammed out of the grooves, the sprocket wheel will then be able to turn relative to the sprocket shaft thereby to limit the amount of torque that may be applied and consequently the amount of force resisting downward pulling of the bead string so as not to cause damage such as breaking the bead string.

To ensure that the beads 168 of the bead string 158 are kept in the sockets 178 of the sprocket wheel 157, the housing 150 may be provided with an axially extending inside wall which closely circumscribes the upper half of the sprocket wheel at its outer diameter. However, it is preferred that there be provided the impact noise buffer seen at 220 in FIGS. 8 and 9. The noise buffer 220 is in the form of a flexible strap 221 which extends circumferentially around the O.D. of the sprocket wheel to retain the balls 168 of the bead string 158 in the sockets 178 of the sprocket wheel. The flexible strap has an upper circular arcuate portion received in a generally semi-circular channel 222 formed between the mated halves 151 and 152 of the sprocket housing 150. The arcuate portion is retained in the channel by small axially protruding, opposed lips 223 and 224 at the radially inner edges of the channel 222, and the channel is of a depth greater than the uniform thickness of the strap to permit radially outward flexing of the strap.

The strap 221 preferably is resiliently urged radially inwardly as by resiliently flexible flaps 228 which angle radially outwardly and engage against the radially outer bottom wall 229 of the channel 222. The strap preferably is made of flexible plastic material such as molded polyethylene, and the flaps preferably are integral with the strap.

Each end of the strap 221 is provided with an integral bead 233 for fixing the strap end to respective side walls 234 of the sprocket housing 150 as at inwardly protruding bosses 235. From each bead 233, the strap extends vertically downwardly, then curves inwardly and then upwardly to form a resilient bumper portion of the strap indicated at 238. The bumper portions 238 are spaced outwardly from respective sloped surfaces 239 of a center guide portion 240 of the sprocket housing 150 to define therebetween respective passages for entry/exit of the bead string flights in the housing.

When the bead string 158 is being pulled in either direction, the beads 168 will impact against the impact noise buffer 220 rather than the relatively rigid interior surfaces of the sprocket housing 150 to minimize noise and also wearing or denting of the beads. The impact buffer also serves to maintain the beads in the sockets 178 of the sprocket wheel 157 as they rotate with the sprocket wheel.

Turning now to FIGS. 12-17, a preferred through-the-wall shaft coupling assembly is indicated generally at 246. Such assembly is preferred over the above-identified flexible shaft 155 for coupling the drive shaft 160 of the operator 29 to the gear actuator 99 of the bi-directional reduction drive 28. The coupling shaft assembly 246 is easy to assembly and provides for positive high torque transmission.

Figures 12, 13, 14, 15, 16, 17:
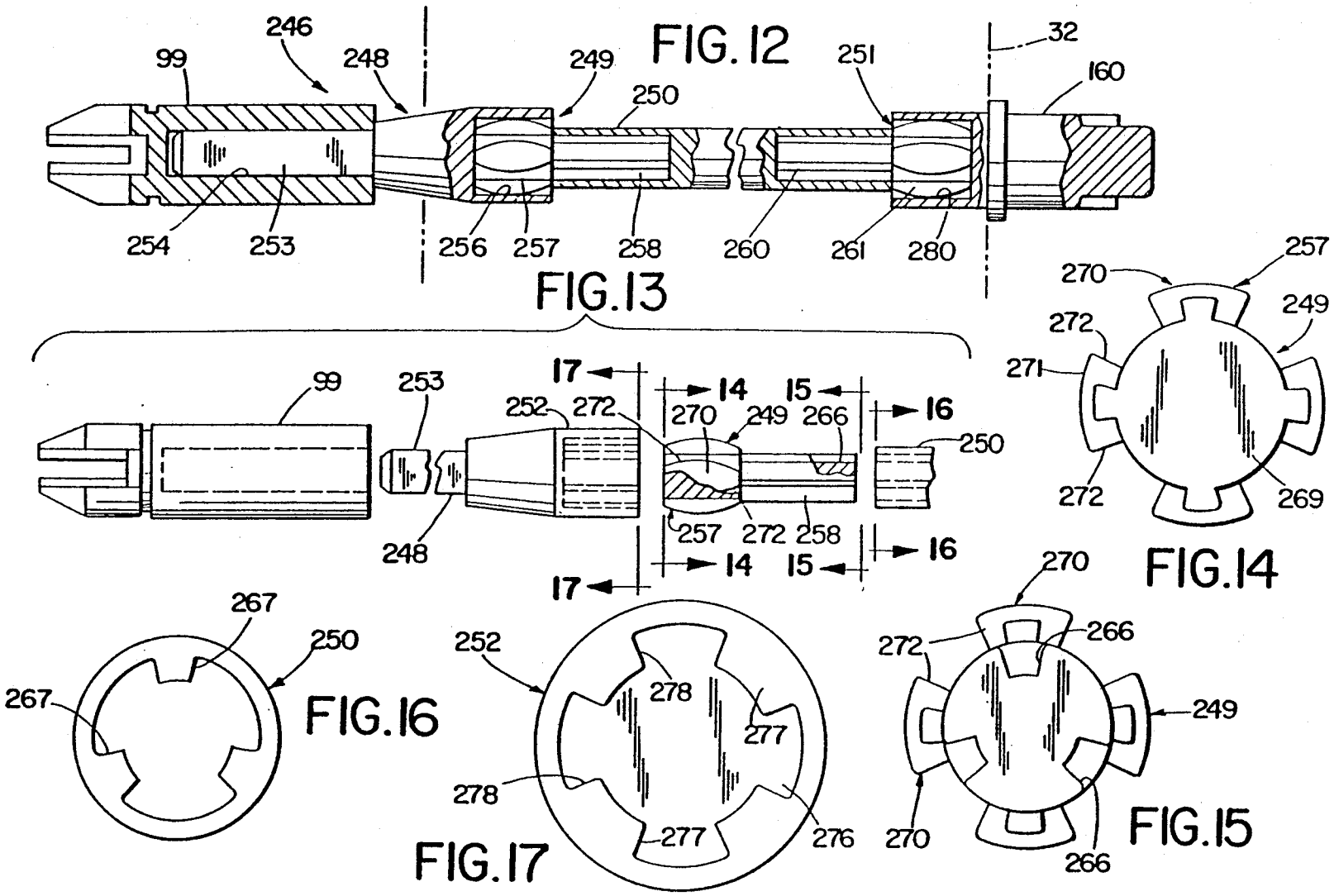
FIG. 12 is a longitudinal section through a preferred drive shaft assembly utilized to couple the operator inside the building wall to drive components outside the building wall.
FIG. 13 is a fragmentary exploded view of a portion of the drive shaft assembly of FIG. 12.
FIGS. 14-17 are views looking generally in the direction of the arrows 14—14, 15—15, 16—16 and 17—17 of FIG. 13, respectively.

Going from left to right in FIG. 12, the shaft coupling assembly 246 includes a universal joint (U-joint) adaptor 248, a U-joint 249, a drive tube 250 and a U-joint 251. The U-joint adaptor 248 has a socket head 252 and a shaft end 253 of square cross-section. The shaft end 253 is axially insertable into an axial bore 254 of the gear actuator 99 which is of corresponding square cross-section.

The socket head 252 of the U-joint adaptor 248 has an axial socket 256 which accommodates the ball end 257 of the universal joint 249. The universal joint 249 has a shaft end 258 which is axially insertable into the adjacent end of the drive tube 250. The U-joint 251 at the other end of the drive tube is identical to the universal joint 249 and accordingly has a shaft end 260 axially insertable into the drive tube. The universal joint 251 also has a ball end 261 which is axially insertable into a socket 262 at the adjacent end of the sprocket shaft 160.

As seen in FIGS. 13 and 15, the shaft end 258 of the universal joint 249 is provided at its outer diameter with three axially-extending grooves 266. The grooves 266 are circumferentially equally spaced apart and sized to receive axially extending splines 267 (FIG. 16) at the inner diameter of the drive tube 250. Accordingly, the splines 267 cooperate with the grooves 266 to couple the universal joint to the drive tube for common rotation. In like manner, the universal joint 251 is coupled at its shaft end 260 to the drive tube 250 for common rotation.

As seen in FIGS. 14 and 17, the ball 257 of the universal joint 249 has a cylindrical core portion 269 from which radiate four axially extending ribs 270. The ribs 270 have a convex outer surface 271 and side surfaces 272 which taper towards one another going from the middle to the ends of the rib 270. Accordingly, the ribs are of greatest transverse width at the middle thereof. On the other hand, the socket end 252 of the universal joint adaptor 248 has a cylindrical outer wall 275 which interiorly defines a socket 276. Extending radially inwardly from the cylindrical wall 275 are four axially extending splines 277. Circumferentially adjacent splines 277 define therebetween respective axially extending grooves 278 which are sized to receive respective ribs 270 of the ball 257 of the universal joint 249. Accordingly, the splines 277 coact with the circumferentially alternately disposed ribs 277 to couple the universal joint to the universal joint adaptor. The splines and ribs also cooperate to permit pivotal movement of the universal joint relative to the universal joint adaptor. Such relative pivotal movement is permitted by reason of the curved surfaces of the ribs on the ball which engage axially extending surfaces defining the grooves 278 in which the ribs are received. In essence, there is formed a ball and socket joint which additionally is provided with circumferentially interfitted ribs and splines for transmitting torque through the joint while permitting relative pivotal movement. Also, at all relatively pivotal positions, the ribs will all remain in driving engagement with the splines.

In like manner, the universal joint 251 is coupled to the sprocket shaft 160 for both common rotation and relative universal pivotal and axial movement. In this case, the sprocket shaft is provided with a splined socket 280 for receiving the ribbed ball 261 of the universal joint 251.

Figure 18:
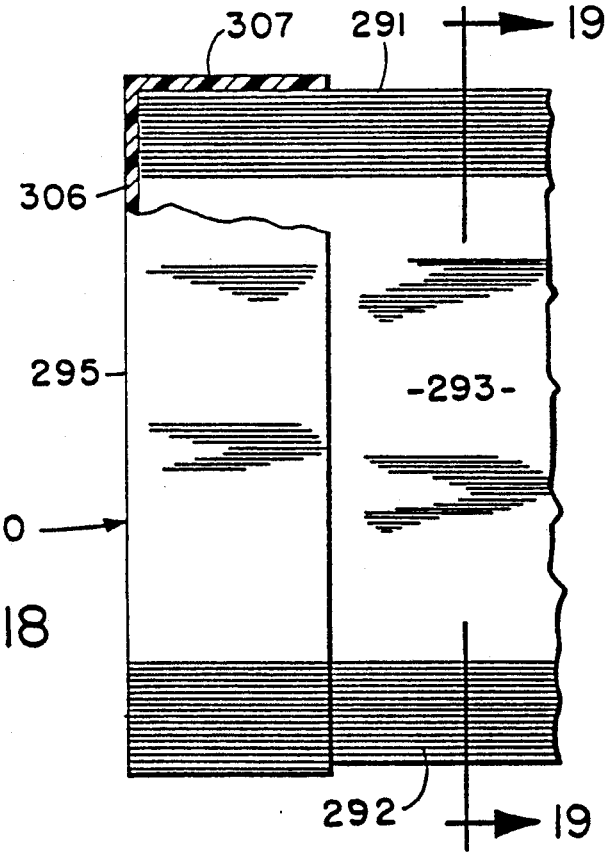
FIG. 18 is a fragmentary front elevational view, partly broken away in section, of a preferred valance for the rolling shutter system.
Figure 19:
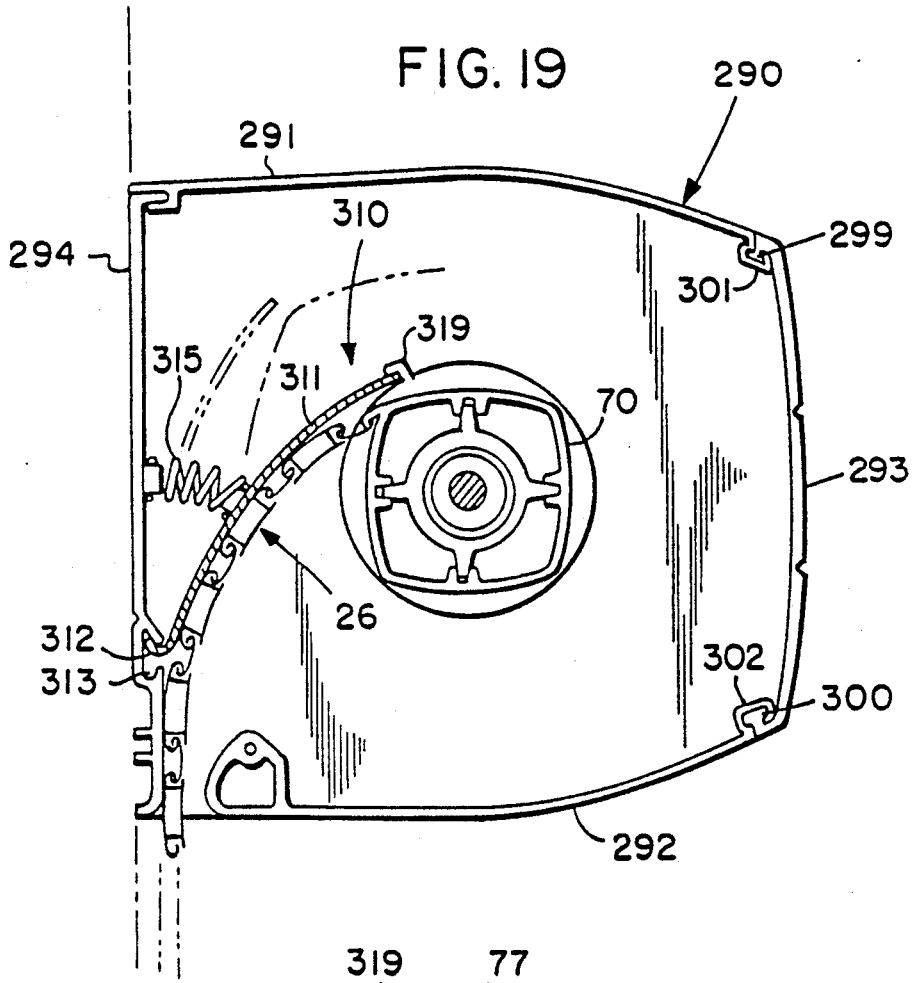
FIG. 19 is a vertical transverse section taken substantially along the line 19—19 of FIG. 18, showing in section the valance and also a shutter travel limiting and anti-lift device.

Referring now to FIGS. 18 and 19, a preferred cover or valance for the rolling shutter system is indicated generally at 290. The valance 290 has top and bottom horizontal panels 291 and 292, a vertical front panel 293 and a vertical back panel 294 generally forming a tubular structure closed at each end by a respective end cap 295. As shown, the top and bottom panels extend generally perpendicular to the back panel 294 and then curve towards one another to their point of joinder with the front panel 293. Accordingly, the front panel 293 has a vertical height less than the maximum height of the valance 290, and the curved forward portions of the top and bottom panels provide a gradual transition between the height of the front panel and the full height of the valance. By reason of this configuration, there is created an optical illusion that the valance has an overall height about equal the height of the front panel 293 rather than the actual overall vertical height of the valance, such overall height being needed to accommodate within the valance the rolling shutter when rolled onto the shutter spool 70. That is, the overall height of the valance when viewed from the front appears to be less than what it actually is by reason of the lesser height front panel 295 and the lack of any perceivable increase in height going from the front panel to the maximum height of the valance.

As is preferred, the front, top and bottom panels 291-293 are formed as individual sections which may be assembled together in the manner shown. More particularly, the front panel 293 may be provided at its edges with full length T-shape locking tongues 299 and 300 which engage in correspondingly shaped full length locking grooves 301 and 302 provided along the front edges of the top and bottom panels 291 and 292. Accordingly, the front panel may be assembled with the top and bottom panels by edgewise inserting the tongues 299 and 300 into the locking grooves 301 and 302.

The front, top and bottom panels 291-293 preferably are made of a plastic material which may be relatively easily cut to length as with scissors or a knife. This greatly facilitates sizing of the valance with tools usually available to the do-it-yourself installer. After the valance has been properly sized by cutting the panels to length, the end caps 295 are telescopically slipped over the ends of the valance panels to cover the edges thereof which may be ragged by reason of the panels having been cut to length. Similar to the end caps shown in FIGS. 3 and 4, the end cap 295 may have a vertical wall 306 and a peripheral flange 307 which overlies the telescoped ends of the valance panels 291-293.

Figure 20:
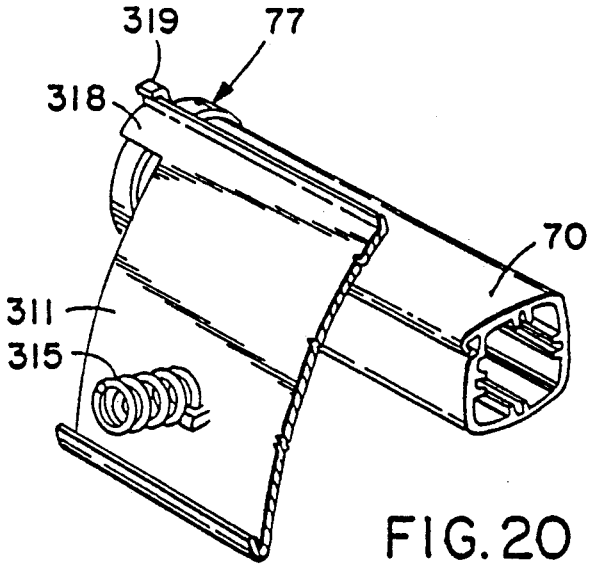
FIG. 20 is a fragmentary perspective view of the shutter travel limiting and anti-lift device.

With reference now being had to FIGS. 19 and 20, a shutter travel limit and anti-lift device is indicated generally at 310. The device 310 includes a curved limit plate 311 which is provided at its bottom edge with an upturned lip 312. The upturned lip 312 is retained for pivotal movement in a horizontal channel 313 provided in the back panel 294. By reason of such pivot connection, the limit panel 311 may swing between its illustrated solid line and phantom line positions.

The limit panel 311 is horizontally coextensive with the rolling shutter schematically indicated at 26 in FIG. 19. A spring 315 is interposed between the limit panel and the back panel 294 thereby resiliently to urge the limit panel against shutter slats rolled onto the shutter spool 70.

As seen in FIG. 20, the limit plate 311 has an end portion 318 which is axially coextensive with an L-shape catch 319 which rotates with the shutter spool 70. The catch 319 may be provided, for example, on the plug member 77 which, as shown in FIG. 4, is located at the end of the shutter spool opposite the worm gear 76. The catch 319 projects radially outwardly by an amount sufficient to engage over the limit plate end portion 318 when the rolling shutter 26 has been fully lowered and unwound from the storage spool 70. By reason of such engagement seen in FIG. 19, further lowering of the shutter is prevented since the limit plate end portion obstructs further rotation of the shutter spool in the shutter lowering direction. Also, the catch hooks over the end portion 318 to prevent rearward upward swinging of the limit plate 311 thereby to securely hold the limit plate in its solid line position in FIG. 19. By virtue of this, any attempt to forcibly lift the fully lowered rolling shutter will be prevented. Any lifting of the rolling shutter will cause the uppermost shutters to be jammed against the limit plate which is held in place by the catch 319. Accordingly, raising of the shutter from its fully lowered position can only be accomplished by rotating the spool 70 clockwise in the above described manner. When the spool is rotated clockwise in FIG. 19, the catch 319 will clear the end portion 318 of the limit plate 311 to permit rearward upward swinging movement of the limit plate as the rolling shutter slots are then wound onto the storage spool. By the time the storage spool is rotated 360° clockwise from its FIG. 19 position, the slats of the shutter rolled onto the storage spool will have caused the limit plate to have swung to a position radially clear of the catch 319.

Although the invention has been shown and described with respect to preferred embodiments, it is obvious that equivalent alterations and modifications will occur to others skilled in the art upon the reading and understanding of the specification. The present invention includes all such equivalent alterations and modifications, and is limited only by the scope of the following claims.

What is claimed is:

1. A rolling shutter system comprising a rolling shutter, drive means rotatable in one direction to wind said shutter into a roll and in the opposite direction to unwind said shutter, means for yieldably applying a force to said drive means to resist rotation of said drive means in said opposite direction, and means for disengaging said means for applying during rotation of said drive means in said one direction.

2. A rolling shutter system comprising a rolling shutter, and bi-directional drive means for rolling and unrolling said shutter, said bi-directional drive means including a sprocket wheel and a bead string trained around said sprocket wheel, said bead string including a plurality of generally round plastic beads affixed to a flexible string, said beads being spaced apart along said string to define therebetween intervals at a spacing substantially equal the average spacing of an adult person's fingers to provide for interdigitation with the fingers of a person's hand, and the beads being sized to provide for substantial axial interference over a relatively large surface area between the fingers and respective said beads.

3. A rolling shutter system as set forth in claim 2, wherein said bead string has flights thereof extending from said sprocket wheel for hand grasping and pulling.

4. A rolling shutter system as set forth in claim 3, wherein said beads are generally round and have a diameter of about 0.438 inch and a center-to-center spacing of about 0.771 inch.

5. A rolling shutter system as set forth in claim 2, including a one-way friction clutch device for causing relatively high frictional resistance to lowering movement of said shutter and relatively low frictional resistance to raising movement of said shutter.

6. A rolling shutter system as set forth in claim 5, wherein said bi-directional drive means is more than 50% efficient, but is rendered less than 50% efficient in a shutter lowering direction by said one-way friction clutch device.

7. A rolling shutter system as set forth in claim 2, wherein said sprocket wheel includes at its outer diameter a plurality of circumferentially arranged sockets for receiving the beads of said bead string trained thereabout.

8. A rolling shutter system as set forth in claim 7, wherein each socket is formed between respective relatively adjacent tooth portions of said sprocket wheel, and each tooth portion has a circumferentially extending groove for receiving the string segment extending between beads received in adjacent sockets.

9. A rolling shutter system as set forth in claim 2, further comprising a housing for said sprocket wheel and means supporting said sprocket wheel in said housing for rotation.

10. A rolling shutter system as set forth in claim 9, wherein said means supporting includes a sprocket shaft on which said sprocket wheel is supported for relative rotation, and further comprising overload slip clutch means for coupling said sprocket wheel to said sprocket shaft for common rotation while allowing said sprocket wheel to rotate relative to said sprocket shaft when torque acting on said sprocket wheel exceeds a predetermined amount.

11. A rolling shutter system as set forth in claim 9, further comprising means located in said housing for retaining the beads of the bead string in the sockets of the sprocket wheel as such beads rotate with said sprocket wheel.

12. A rolling shutter system as set forth in claim 11, wherein said means for retaining is flexible and resilient to minimize noise.

13. A rolling shutter system comprising a rolling shutter, bi-directional drive means for rolling and unrolling said shutter, and a one-way friction clutch device for causing relatively high frictional resistance to lowering movement of said shutter and relatively low frictional resistance to raising movement of said shutter, said bi-directional drive means including a sprocket wheel and a bead string trained around said sprocket wheel, said bi-directional drive means further including a worm and worm gear, and said one-way friction clutch device including a friction element and clutch means for coupling said friction element to said worm for rotation with said worm in one direction only.

14. A rolling shutter system as set forth in claim 13, wherein said friction element and worm have respective axial end faces normally urged against respective opposing surfaces by the weight of an unrolled portion of the rolling shutter, and the axial end face of said friction element has a diameter greater than the axial end face of said worm so that friction forces at the axial end face of said friction element act on a moment arm greater than that of friction forces at the axial end face of said worm.

15. A rolling shutter system as set forth in claim 13, wherein said clutch means includes a coil spring constricted around an axial end portion of said worm, and means connecting the friction element to one end of the coil spring.

16. A rolling shutter system as set forth in claim 13, wherein said bead string includes a plurality of generally round plastic beads secured to a flexible string.

17. A rolling shutter system comprising a rolling shutter, bi-directional drive means for rolling and unrolling said shutter, said bi-directional drive means including a sprocket wheel and a bead string trained around said sprocket wheel, a housing for said sprocket wheel, means supporting said sprocket wheel in said housing for rotation, said means supporting including a sprocket shaft on which said sprocket wheel is supported for relative rotation, and overload slip clutch means for coupling said sprocket wheel to said sprocket shaft for common rotation while allowing said sprocket wheel to rotate relative to said sprocket shaft when torque acting on said sprocket wheel exceeds a predetermined amount, said overload slip clutch means including a spider clutch spring having a hub portion keyed to said sprocket shaft and radial arms urged by their resilience into engagement with the sprocket wheel.

18. A rolling shutter system as set forth in claim 17, wherein said bead string includes a plurality of generally round plastic beads secured to a flexible string.

19. A rolling shutter system comprising a rolling shutter, bi-directional drive means for rolling and unrolling said shutter, said bi-directional drive means including a sprocket wheel and a bead string trained around said sprocket wheel, said bead string including a plurality of generally round beads, a housing for said sprocket wheel, means supporting said sprocket wheel in said housing for rotation, and means located in said housing for retaining the beads of the bead string in the sockets of the sprocket wheel as such beads rotate with said sprocket wheel, said means for retaining being flexible and resilient to minimize noise, and said means for retaining including a flexible strap having integral flaps for resiliently supporting said flexible strap.

20. A rolling shutter system as set forth in claim 19, wherein said flexible strap has curved end portions forming resilient bumpers for beads passing through an opening in said housing to and from said sprocket wheel.

21. A rolling shutter system as set forth in claim 19, wherein said beads are plastic and are secured to a flexible string.

22. A rolling shutter system comprising a rolling shutter, bi-directional drive means for rolling and unrolling said shutter, said bi-directional drive means including a sprocket wheel and a bead string trained around said sprocket wheel, a pair of vertical guide rails for said shutter, reel means for raising and lowering said shutter in said guide rails by rolling and unrolling said shutter, a catch rotatable with said reel means, and an obstruction movable in relation to the rolled condition of the shutter for engaging said catch to prevent further rotation of said reel means in a shutter lowering direction only when said shutter is fully lowered in said guide rails.

23. A rolling shutter system as set forth in claim 22, wherein said obstruction bears against the outer diameter of the rolled portion of the shutter for radially inner and outer movement corresponding respectively to contraction and expansion of the rolled portion of the shutter, and said obstruction only in its radially innermost position engaging said catch to prevent further rotation of said reel means in a shutter lowering direction.

24. A rolling shutter system as set forth in claim 23, wherein said catch when engaged against said obstruction operates to lock said obstruction against movement, and said obstruction when locked against movement serves to block lifting of the rolling shutter.

25. A rolling shutter system as set forth in claim 22, wherein said bead string includes a plurality of generally round plastic beads secured to a flexible string.

26. A rolling shutter system comprising a rolling shutter, bi-directional drive means for rolling and unrolling said shutter, said bi-directional drive means including a sprocket wheel and a bead string trained around said sprocket wheel, said sprocket wheel being interiorly mountable to a side wall of a building, and said bi-directional drive means including a rotating member exteriorly mountable to the side wall and a shaft assembly extendable through an opening in the side wall for coupling said sprocket wheel to said rotating member, said shaft assembly including a drive tube and a universal joint at each end of said drive tube, each universal joint including a ball and socket, and said ball and socket respectively having axial ribs and splines interengaging to transmit torque while permitting relative pivoting movement of said ball and socket.

27. The system of claim 26, wherein said splines have axially extending side surfaces, and said ribs have convexly curved outer and side surfaces, the latter being engageable with respective side surfaces of the splines.

28. A rolling shutter system as set forth in claim 26, wherein said bead string includes a plurality of generally round plastic beads secured to a flexible string.

29. A rolling shutter system comprising a rolling shutter, bi-directional drive means for rolling and unrolling said shutter, said bi-directional drive means including a sprocket wheel and a bead string trained around said sprocket wheel, a pair of end plates and a shutter spool journaled between said end plates, said drive means being operable to rotate said shutter spool in opposite directions, said drive means including a worm supported for rotation in a chassis, and said chassis being selectively securable to either of said end plates by a respective one of two sets of attachment elements cooperating with attachment members of the respective end plate, the attachment members of each end plate being a mirror image of those of the other, and the attachment elements of each set being symmetrically disposed with respect to those of the other set in relation to a plane through the rotational axis of the worm.

30. The system of claim 29, wherein said attachment elements include tabs and said attachment members include pockets for receiving respective tabs.

31. The system of claim 29, wherein only one screw fastener is employed to secure the chassis to either one of said end plates.

32. A rolling shutter system as set forth in claim 29, wherein said bead string includes a plurality of generally round plastic beads secured to a flexible string.

* * * * *

UNITED STATES PATENT AND TRADEMARK OFFICE

CERTIFICATE OF CORRECTION

PATENT NO. : 5,117,893

DATED : June 2, 1992

INVENTOR(S) : DONALD L. MORRISON et al.

It is certified that error appears in the above-identified patent and that said Letters Patent is hereby corrected as shown below:

Column 8, line 67, "inroduce" should be --introduce--

Column 16, line 22, "as set forth in claim 3" should be --as set forth in claim 2--

Signed and Sealed this

Twenty-second Day of March, 1994

*Attest:*

*Attesting Officer*

BRUCE LEHMAN

*Commissioner of Patents and Trademarks*